US005359812A

United States Patent [19]

Mayfield

[11] Patent Number: 5,359,812

[45] Date of Patent: Nov. 1, 1994

[54] FINGER GUARD

[76] Inventor: Charles D. Mayfield, 373 Arglen Dr., Owatonna, Minn. 55060

[21] Appl. No.: 140,517

[22] Filed: Oct. 25, 1993

[51] Int. Cl.[5] ..... E06B 7/16

[52] U.S. Cl. ..... 49/383

[58] Field of Search ..... 49/383; 16/250, 251, 16/225; 160/40, 222, 226, 228, 229.1, 230, 331.1, 231.2

[56] References Cited

U.S. PATENT DOCUMENTS

| | | | |
|---|---|---|---|
| 1,444,398 | 2/1923 | Shepherd | 49/383 X |
| 1,626,844 | 5/1927 | Kuhn | 49/383 X |
| 2,691,792 | 6/1953 | Peeler | 16/86 |
| 2,694,234 | 11/1954 | Roby et al. | 20/16 |
| 2,995,285 | 8/1961 | Hallenbeck | 20/16 |
| 3,302,690 | 2/1967 | Hurd | 160/40 |
| 3,319,697 | 5/1967 | Krohn | 160/229 |
| 4,040,142 | 8/1977 | Ippolito . | |
| 4,261,140 | 4/1981 | McLean | 49/383 |
| 4,845,892 | 7/1989 | Pinto | 49/383 |
| 4,878,267 | 11/1989 | Roach . | |

FOREIGN PATENT DOCUMENTS

| | | | |
|---|---|---|---|
| 620030 | 4/1927 | France | 49/383 |
| 2664936 | 1/1992 | France | 49/383 |
| 3435615 | 4/1985 | Germany | 49/383 |
| 3153 | of 1857 | United Kingdom | 49/383 |
| 10278 | of 1894 | United Kingdom | 49/383 |

*Primary Examiner*—Peter M. Cuomo
*Assistant Examiner*—Jerry Redman
*Attorney, Agent, or Firm*—Jacobson & Johnson

[57] ABSTRACT

A slidable door guard for temporarily bridging covering the opening between a door and a casing, with the door guard having a first engaging or male member and a second receiving or female member having a pocket therein to slidingly hold at least a portion of the male member therein as the door is opened and closed to prevent children from accidently crushing their fingers as the door is closed.

10 Claims, 2 Drawing Sheets

FINGER GUARD

FIELD OF THE INVENTION

This invention relates generally to door guards and, more specifically, to door guards to prevent little children from getting their fingers pinched between the door and the door jamb of self closing screen doors and the like.

BACKGROUND OF THE INVENTION

One of the problems with hinged doors is that, as the door is swung open, a gap is formed between the edge of the door and the door jamb. When the door is closed, the gap closes as the edge of the door moves into the gap. However, because of the mechanics of the door, the door itself becomes a lever arm where closing the door with only a small force can generate a substantial force at the edge of the door which can crush or break a child's finger located in the gap between the door and the door jamb. Small children are often unaware of the danger and may place their fingers in the gap between the door and the door jamb.

The prior art is replete with various types of door guards. However, some of the guards must be specially modified to fit the door or the door casing by placing the guard between the door and the door jamb. Others have some type of protrusion which projects outward when the door is opened or closed. And still others have members that ride or wear against the door, causing damage to the door. Since door guards are usually only necessary when children are small, one desires to have a door guard to quickly and temporarily attach to the door and the door casing, and when the children become aware of the dangers of placing their fingers between the door and the jamb, the door guard can be removed.

The present invention provides an inexpensive door guard that prevents little children from having a closing door crush their fingers. The door guard lays flat along the door and casing and does not protrude outward to interfere with the motion of the door or to interfere with any person going in or out.

DESCRIPTION OF THE PRIOR ART

U.S. Pat. No. 2,995,785 shows a door guard having a U-shape with members extending on the opposite sides of the door. The U-shaped members have rollers that roll along the surface of the door. Besides marring the door through wear, the unit requires removal of the door for installation of the door guard.

U.S. Pat. No. 4,040,142 shows a safety device which folds outward when the door is closed and folds inward to cover the opening when the door is open. When in the closed position or the open position, the door guard folded-out portion protrudes outward to provide an obstacle for those who pass through the door.

U.S. Pat. No. 4,878,267 shows a door guard having a closed shape which fits in the opening between the door and the door jamb and requires reworking the door and the door jamb to accommodate the thickness of the door guard.

U.S. Pat. No. 2,641,792 shows a hinge guard which protrudes outward when the door is open or closed.

U.S. Pat. No. 2,694,234 shows a finger guard for swinging doors in which members project outward from each side of the door casing and the door.

U.S. Pat. No. 3,302,690 shows a guard for multiple-section doors in which door guard units project outward.

U.S. Pat. No. 3,319,697 shows a garage-door guard where members slide along the outside of the garage door during the opening and closing of the garage door.

U.S. Pat. No. 4,710,049 shows a safety hinge which is padded to prevent injury to the child.

U.S. Pat. No. 1,444,398 shows a hinge guard having a bellows-like member which expands and contracts to cover the opening between the door and the casing.

BRIEF SUMMARY OF THE INVENTION

The invention comprises a slidable door guard for temporarily bridging and covering the opening between a door and the door casing, with the door guard having a male member and a female member having a wear pocket to secure and hold the first member therein as the door is opened and closed.

DESCRIPTION OF THE PREFERRED EMBODIMENT

Figure 1:
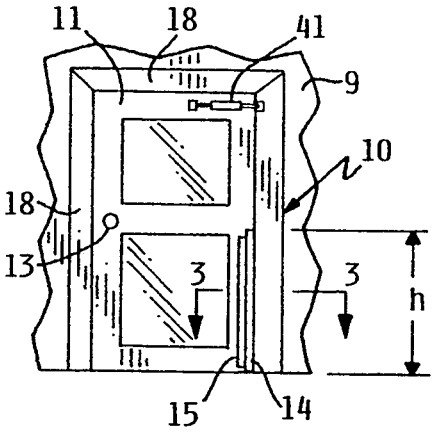
FIG. 1 is a partial cut-away view of a door and casing with my door guard therein.
Figure 3:
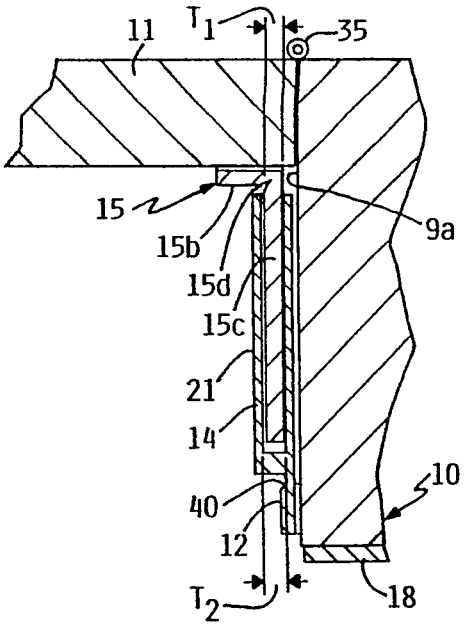
FIG. 3 is a cross-sectional view taken along line 3—3 of FIG. 1 showing the door in the closed position.
Figure 4:
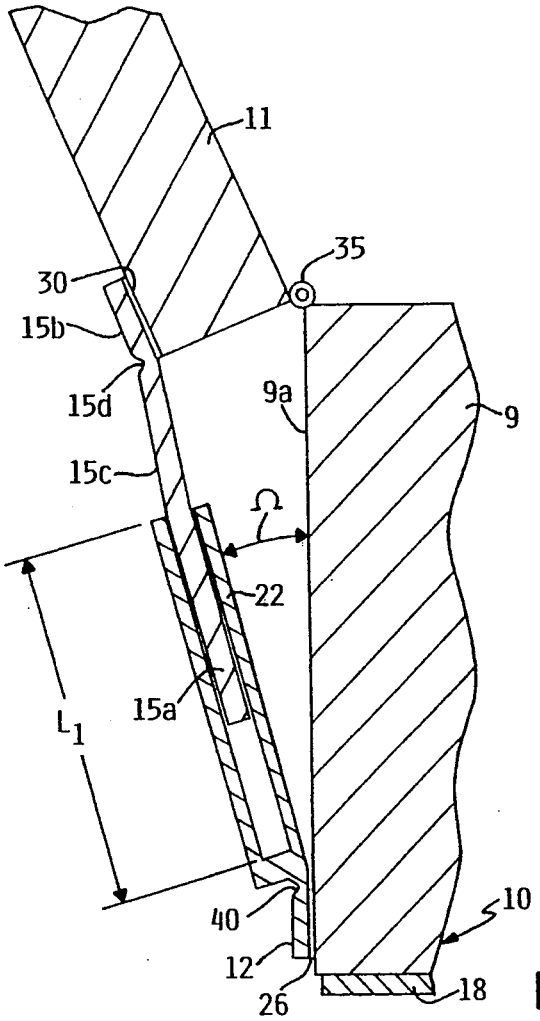
FIG. 4 is a cross-sectional view taken along line 3—3 of Figure showing the door in a partially open position.

FIG. 1 reference numeral 9 generally identifies the wall of a house with a screen door 11 located therein. Door 11 fits within the confines of a door jamb 10 and an outer casing 18 and includes a door knob 13 for opening and closing door 11 and a door closure member 41. Located along the right edge of door 11 is my door guard comprising a first rigid engaging or male member 15 and a second receiving or female member 14 secured to the casing. Located along the opposite side of door 11 are hinges 35 (FIG. 3 and 4). Female member has a length h that extends approximately 36 inches; however, if desired member 14 and member 15 could extend along the entire side of door 11.

Figure 2:
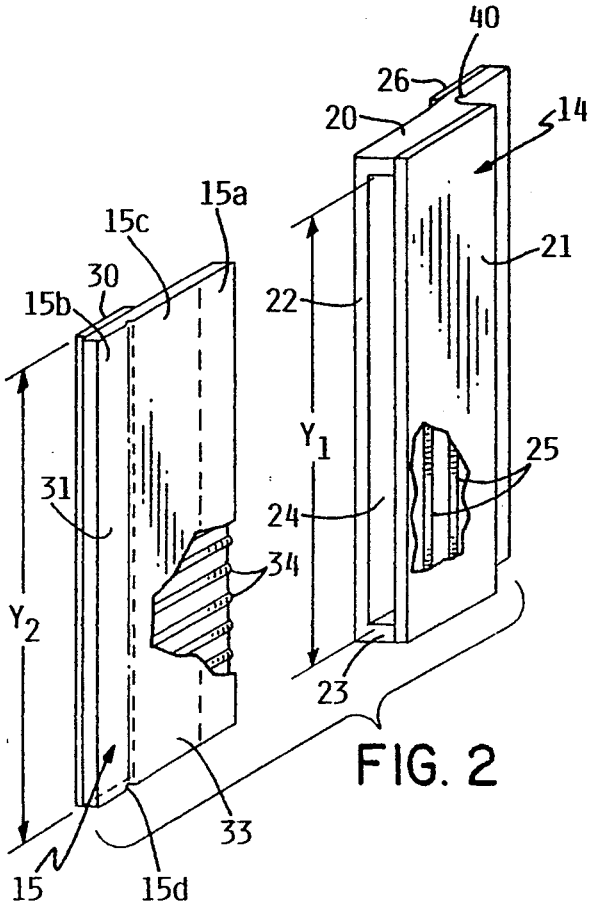
FIG. 2 is an exploded pictorial view of the door guard of my invention.

FIG. 2 shows the door guard of my invention in greater detail. My door guard comprises a first one-piece rigid male member 15 having an integral hinging region **15*d* and a general rectangular and elongated shape 33 and a female member 14 also having an integral hinging region 40 and a general rectangular and elongated shape. First member 15 has a strip of pressure sensitive adhesive 30 located on one side thereof. Male member 15 comprises three distinct regions. A first elongated region 15*b* extends along one edge of member 15, an intermediate region 15*c* extends along the interior region of member 15 and an edge region 15*a* extends along the outer portion of member 15. Members 15*a* and 15*c* slidingly engage the female member, while member 15*b* remains fixed to door 11 and therefore outside of female member 14**.

FIG. 2 shows the male member 15 partially cut away to reveal the orientation of the corrugation or ribs 34 when the unit is made of rigid material such as cardboard; that is, the ribs 34 run latitudinally or perpendicular to the door side casing 18 to allow the member 15 to lay flat along the door and to pivot at the flexible hinging region **15*d* as the door 11** is opened.

The female member 14 comprises a first outer member 21, an inner member 22, a lower end member 23 and a top end member 20 to form an enclosed guide and wear pocket 24 for first member 15 to slide therein. First member 15 has a height denoted by $Y_2$ and second, more flexible female member 14 has a pocket opening height denoted by $Y_1$ which is slightly larger than $Y_2$ to allow member 15 to slidingly fit within pocket 24. A pressure sensitive adhesive 26, located on edge member 12 of member 14, permits quick and temporary attachment of member 14 to the door casing 18.

In the embodiment shown in FIG. 2, when the door guard members are made of cardboard, the corrugation or ribs 25 of member 14 run in the vertical direction to provide the minimum necessary rigidity against latitudinal (top to bottom) warping. Located along the back side of member 14 is a pressure sensitive adhesive strip 26 for securing member 14 to the door casing or the like. While an adhesive is shown for fastening both members of the door guard, other means of fastening such as nails or screws could be used to hold my door guard in position. Pressure sensitive adhesives are preferred, however, because after the door guard has served its protective purpose, the door guard and adhesives can generally be removed without any permanent damage to the door or the casing.

To understand the operation of the invention, refer to FIGS. 3 and 4. FIG. 3 shows two closure members comprising door 11 and door jamb 9*a* for ingress and egress therethrough. FIG. 3 shows the door guard in a normal position with the door closed. In this condition the door guard male member 15 lays dormant, bent at approximately 90 degrees at creased flexible hinging region 15*d*, fully inserted and housed by female member 14. Second member 14 fully receives member 15*c*, lays flat against door jamb 9*a*. Note that door guard member 15 has a thickness $T_1$ which is slightly smaller than the thickness $T_2$ of the opening in member 14 to permit sliding of member 15 within wear pocket 24 without binding therein. Yet not large enough for a child to insert his or her fingers therebetween.

FIG. 4 illustrates what happens as the door is opened. As the door 11 is swung open, about hinge 35, a portion 15*c* of member 15 slides out of pocket 24. As it does so, female member 14 pivots at creased flexible hinging region 40, expanding the reception angle $\Omega$ to accommodate the movement of rigid male member 15 in a smooth and fluid manner, as it is pulled by the door both away from the door jamb 9*a* and out of pocket 24. In so doing, male member 15 and female member 14 jointly operate to prevent insertion of body pans in between the door 11 and door jamb 9*a*. The pocket 24 has a length sufficiently long (designated by $L_1$) so that, in the fully opened position, the door guard member 15 will have portion 15*a* retained and restrained by outer member 21 of member 14. Because members 15 and 14 are stationary in respect to their attachment to the door 11 and door jamb 9*a* respectively, any wear from the repeated opening and closing of the door is born by members 15 and 14 and not by the door or the door casing. Consequently, when the door guard is removed, neither the door nor the door jamb carries any wear marks from the door guard rubbing there against.

While the embodiment is shown with male member 15 located on door 11 as an alternate embodiment, male member 15 could be secured to the door casing or jamb, and female member 14 secured to door 11 without deviating from the spirit and scope of my invention. In addition, although only one pocket is shown additional pockets could be used.

I claim:

1. A slidable door guard for temporarily bridging an opening between a door and a casing comprising:

a male member having a first portion securable to a first surface, said male member having a second portion for extending away from said first portion, said first portion hingedly connecting to said second portion;

a female member securable to a second surface, opposite said male member, said female member including an edge member having a hinged region formed in said female member, said female member having a wear pocket therein for slidingly receiving said second portion of said male member, so that, when the door is opened, said female member pivots about said hinged region and said second portion of said male member slides partially out of said wear pocket to cover the opening between the door and the casing to prevent children from sticking their fingers therein and being injured as the door is closed.

2. The door guard of claim 1 wherein the male member is made of corrugated cardboard.

3. The door guard of claim 2 wherein the female member is made of corrugated cardboard.

4. The door guard of claim 2 wherein the male member has a length sufficiently long so when the door is fully opened a portion of said male member remains in said pocket of said female member.

5. The door guard of claim 1 wherein the male member is elongated and is made of corrugated cardboard with the cardboard having corrugations that run perpendicular to the elongated direction of the said male member.

6. The door guard of claim 1 wherein the male member includes an adhesive for securing the male member to the first surface.

7. The door guard of claim 1 wherein the male member has a first thickness $T_1$ and the pocket in said female member has a width slightly greater than $T_1$ to permit said male member to slide freely in said pocket in said female member.

8. The door guard of claim 7 wherein the male member contains an adhesive for securing the male member to the first surface.

9. The door guard of claim 1 wherein the female member has a length that extends approximately 36 inches.

10. A slidable door guard for temporarily bridging an opening between a door and a casing comprising:

a male member having a first portion and a second portion, said second portion pivotally connected to said first portion through an integral hinging region, said second portion for extending over the opening between a door and a door casing; and a female member, said female member including an edge member having a hinged region integrally formed in said female member, said female member having a pocket therein for slidingly receiving said second portion of said male member, so that, when the door is opened, said male member and said female member pivot about their respective hinging regions to enable said second portion of said male member to slide partially out of said pocket to cover the opening between the door and the casing to prevent children from sticking their fingers therein and being injured as the door is closed.

* * * * *